United States Patent [19]

Musgrave

[11] 4,107,863

[45] Aug. 22, 1978

[54] MAGAZINE ENGAGEMENT MEANS

[76] Inventor: Daniel Dennis Musgrave, 8201 Caraway St., Cabin John, Md. 20731

[21] Appl. No.: 794,102

[22] Filed: May 5, 1977

[51] Int. Cl.[2] ..... F41C 25/02

[52] U.S. Cl. ..... 42/50; 42/1 MH; 42/90

[58] Field of Search ..... 42/50, 49 R, 6, 7, 1 MH, 42/87, 88, 90, 1 R, 18

[56] References Cited

U.S. PATENT DOCUMENTS

| | | | |
|---|---|---|---|
| 1,074,948 | 10/1913 | Hiscock | 42/50 |
| 1,229,721 | 6/1917 | Cooke | 42/50 |
| 1,245,499 | 11/1917 | Orme | 42/50 |

*Primary Examiner*—Charles T. Jordan

[57] ABSTRACT

Means for engaging a cartridge magazine with a support in a convenient attitude for ready insertion into a firearm. In order that insertion may be accomplished by moving either the firearm or the magazine, or both, the engagement means is so located relative to the magazine that it can not interfere with complete insertion.

15 Claims, 12 Drawing Figures

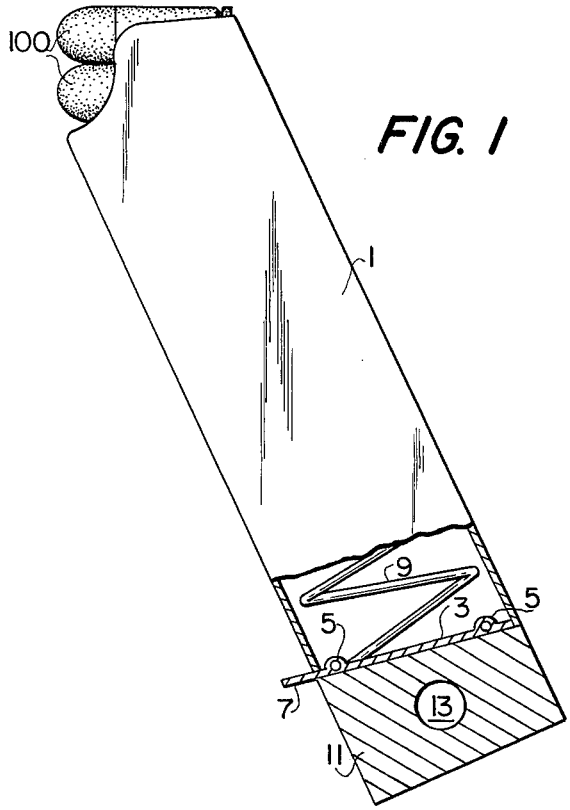
FIG. 1
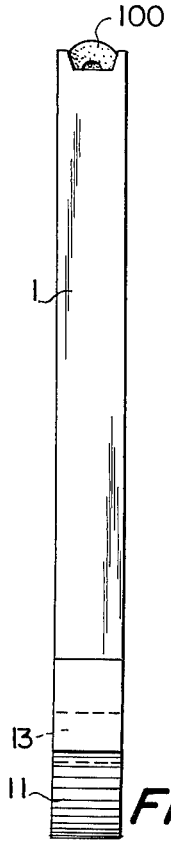
FIG. 2
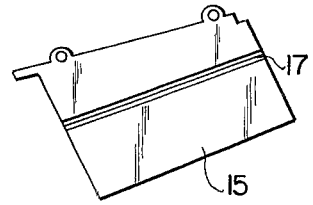
FIG. 4
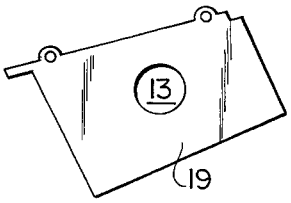
FIG. 3
FIG. 5
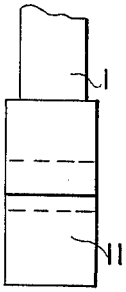
FIG. 6
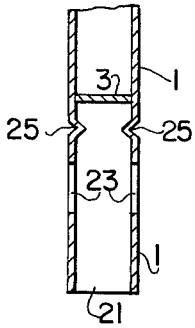
FIG. 7
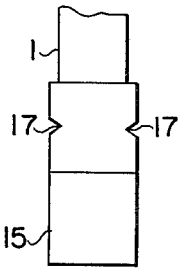
FIG. 8
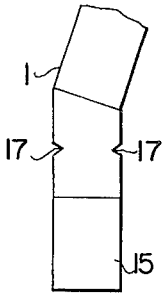
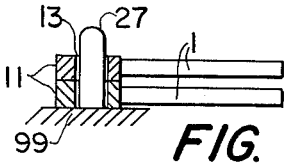
FIG. 9
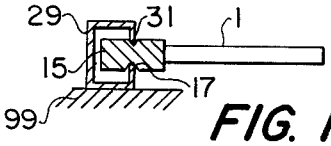
FIG. 10
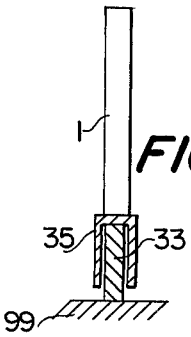
FIG. 11
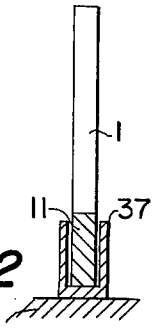
FIG. 12

MAGAZINE ENGAGEMENT MEANS

Many modern firearms use detachable magazines which are removed from the firearm and replaced when empty. The exchange of magazines sometimes takes place at a critical moment, perhaps in military combat, where any considerable delay is unacceptable. One source of delay is the necessity for orienting each magazine correctly before inserting it into its receptable on the firearm.

The principal object of this invention is to provide engagement means on a cartridge magazine whereby said magazine can be engaged with a support in an attitude most convenient to a user who is about to insert it into a firearm.

This and other objects of the present invention will be apparent upon reference to the following specification, taken in connection with the accompanying drawings, wherein:

FIG. 1 is a side elevation, partly sectioned, of a cartridge magazine incorporating the present invention.

FIG. 2 is a rear elevation of the magazine shown in FIG. 1.

FIG. 3 shows a variation of the invention disclosed in FIGS. 1 and 2.

FIG. 4 shows another variation of the invention.

FIG. 5 shows a variation in dimensions to suit circumstances.

FIG. 6 shows a variation whereby the invention is made integral with the casing of the magazine.

FIG. 7 shows a rear view of the variation disclosed in FIG. 4.

FIG. 8 shows a variation wherein all axes of the magazine and the engagement means do not coincide.

FIG. 9 shows schematically the engagement of magazine with a stud on a supporting structure.

FIG. 10 shows schematically the engagement of a magazine with a channel on a supporting structure.

FIG. 11 shows schematically the engagement of a magazine with a lug on a supporting structure.

FIG. 12 shows schematically the engagement of a magazine with a socket on a supporting structure.

The particular magazine shown in the drawings was selected only as a convenience for purpose of disclosure of the invention. It is not intended thereby to limit the utility of the invention to any magazine or class of magazines.

Referring to the drawings in detail FIG. 1 shows a cartridge magazine comprising a casing 1, a floor 3, and a spring 9. At the top of the casing are visible portions of cartridges 100 which are urged toward a feeding position by a follower (not visible in the drawing) within the casing. The floor is secured to the casing by pins 5 in the well-known manner. The floor also has a projection 7 which may be used in withdrawing the inserted magazine from a firearm if it should tend to stick therein. The details described thus far are well known in the art.

Affixed to the magazine and extending a substantial distance below floor 3 is an engagement member 11. As will be explained hereinafter the engagement member may vary in size and shape, to make it compatible with different supporting structures. In FIG. 1 member 11 is fixed to floor 3 in any convenient manner and it has a lateral hole 13 formed through it.

A back view of the magazine with the engagement member attached is shown in FIG. 2. In FIGS. 1 and 2 the member has substantially the same length (front-to-rear) and width as casing 1.

FIG. 3 shows that the engagement member may be fabricated integral with the floor, the integral assembly being indicated by numeral 19. It also has a lateral hole 13.

FIG. 4 also shows the engagement member fabricated integral with the floor, but it is without the lateral hole and has grooves 17 formed in its sides, only one of which is visible in FIG. 4. The member with the grooves is indicated by numeral 15.

It is not necessary that member 11 be the same width as casing 1. As shown in FIG. 5 it can have a greater width. Although not disclosed in the drawings, it can also have a lesser width.

The engagement member can also be made as an extension of casing 1, as disclosed in FIG. 6. The walls of the casing are extended substantially below floor 3 to enclose a hollow space 21. Through the walls are formed lateral holes 23, and in the walls are formed grooves 25. Holes 23 are equivalent to holes 13 in member 11, and grooves 25 are equivalent to grooves 17 in member 15. The purpose of the holes and grooves will be explained hereinafter.

FIG. 7 shows a rear view of an engagement member such as 15 in FIG. 4, but affixed to a magazine which is indicated by casing 1. FIG. 7 is intended to show that the width of the member can be greater than the width of the casing. Although not shown in the drawings it can also have a lesser width.

FIG. 8 shows that member 15 can be also affixed to the magazine (indicated by casing 1) with at least one axis of the magazine and the member not parallel.

FIG. 9 shows a stud 27 on a supporting structure 99. Two magazines, indicated by casings 1, are engaged with the stud by holes 13. For convenience of illustration, the magazines are grouped together. In actual practice they might be positioned on the stud so as to form an angle, in which position the top most could easily be grasped for insertion into a firearm.

FIG. 10 shows a channel 29 having resilient jaws 31, and carried on a supporting structure 99. The jaws are engaged with grooves 17 of member 15, fixed to a magazine the casing of which is shown at 1. The magazine can be quickly disengaged, either by sliding the grooves out of the jaws, or by springing the jaws apart.

FIG. 11 shows a magazine, indicated by casing 1, having affixed thereto a hollow engagement member 35. The hollow member, which might be polygonal, is encompassing a geometrically similar lug 33 carried on a supporting structure 99. The magazine can be quickly disengaged by sliding the hollow member off the lug.

FIG. 12 shows a magazine, indicated by casing 1, and having affixed thereto an engagement member such as 11 in FIG. 1. The member is inserted into a socket 37 carried on a supporting structure 99. The socket may be polygonal, or otherwise, to accommodate the member. The magazine can be quickly disengaged by sliding the member out of the socket.

The disengagement of the magazine from the supporting structure, in each of the arrangements described above can be accomplished by hand, or the firearm can be moved so that the magazine receptacle therein encompasses the magazine, which is then disengaged from the supporting structure by moving the firearm.

It might be advantageous in some instances to provide for magnetic attraction between the engagement member on the magazine and the element on the supporting structure with which it engages. The member could comprise a magnet, and the stud, channel, lug, socket, or other element with which it engages could comprise magnetic material. Obviously, the arrangement could also be vice versa. Magnetic attraction could thus be used to assist in maintaining engagement of the magazine with the supporting structure.

The supporting structure might be part of a vehicle, a boat, or an aircraft; preferably some part which is accessable to the person intending to use the magazine. Or it might be an article of clothing or equipment worn on the person of the user; preferably such that the magazine will be supported in the most convenient position and correct orientation for insertion into a firearm.

In some arrangements, such as that shown in FIG. 9, it may be desirable to make the engagement member wider than the magazine casing to permit easier grasping of the casing when several magazines are stacked together. Also, when several magazines are supported in a parallel row, it may be desirable to have some of them at a slight angle relative to others. This can be accomplished by fixing the engagement member to the magazine at an angle as in FIG. 8.

There is thus disclosed a magazine engagement means which can cooperate with a supporting structure to support a magazine in an extended manner which facilitates insertion of said magazine into a firearm. The disclosure is exemplary only, and it is not intended to limit the invention to the embodiments disclosed herein.

What I claim is:

1. In a cartridge magazine including a casing and a floor: a member affixed to said magazine and extending a substantial distance below said floor, said member comprising an extension of said casing; and at least one hole in said member adapted for releaseable engagement with a supporting structure whereby said magazine can be supported in an extended manner.

2. A magazine as set forth in claim 1 wherein said member is wider than said casing.

3. In a cartridge magazine including a casing and a floor: a member affixed to said magazine and extending a substantial distance below said floor; and at least one groove in said member adapted for releaseable engagement with a supporting structure whereby said magazine can be supported in an extended manner.

4. A magazine as set forth in claim 3 wherein said member and said floor are integral.

5. A magazine as set forth in claim 3 wherein said member comprises an extension of said casing.

6. A magazine as set forth in claim 3 wherein said member is wider than said casing.

7. A magazine as set forth in claim 3 wherein all axes of said member are parallel to corresponding axes of said magazine.

8. A magazine as set forth in claim 3 wherein al least one axis of said member is angularly related to a corresponding axis of said magazine.

9. In a cartridge magazine including a casing and a floor: a member affixed to said magazine and extending a substantial distance below said floor, said member being adapted for releaseable engagement with a socket on a supporting structure whereby said magazine can be supported in an extended position.

10. A magazine as set forth in claim 9 wherein said member is hollow.

11. A magazine as set forth in claim 9 wherein said socket has a polygonal recess.

12. A magazine as set forth in claim 9 wherein said member comprises magnetic material.

13. A magazine as set forth in claim 9 wherein said member is a magnet.

14. A magazine as set forth in claim 9 wherein said socket includes magnetic means positionally adapted to contact said member.

15. A magazine as set forth in claim 9 wherein said supporting structure comprises magnetic material.

* * * * *